United States Patent [19]

Suneborn

[11] Patent Number: 4,901,057

[45] Date of Patent: Feb. 13, 1990

[54] DEVICE FOR SECURING A COMBINATION DIAL LOCK

[76] Inventor: Lars R. Suneborn, 26946 Fortrose, Mission Viejo, Calif. 92691

[21] Appl. No.: 182,157

[22] Filed: Apr. 15, 1988

[51] Int. Cl.[4] ..... E05B 45/06

[52] U.S. Cl. ..... 340/542; 70/211; 70/439

[58] Field of Search ..... 340/542–543, 340/528–529, 825.65; 200/43.11, 43.17, 43.19, 43.21, 61.64; 361/171; 109/38–44; 70/209–211, 286, 432, 439

[56] References Cited

U.S. PATENT DOCUMENTS

| | | | |
|---|---|---|---|
| 2,923,928 | 2/1960 | McLaughlin | 340/543 |
| 3,723,682 | 3/1973 | Pecott | 340/543 X |
| 3,967,846 | 7/1976 | Schlage | 70/210 X |
| 3,971,240 | 7/1976 | Love, Sr. | 70/211 X |
| 4,085,600 | 4/1978 | Bindari | 70/211 X |
| 4,772,877 | 9/1988 | Rice, Jr. et al. | 340/543 |

*Primary Examiner*—Glen R. Swann, III
*Assistant Examiner*—Thomas J. Mullen, Jr.
*Attorney, Agent, or Firm*—W. Kirk McCord

[57] ABSTRACT

A device for securing a combination dial lock is comprised of a base member, a bridge member, which is pivotally mounted on the base member, and a cover member which substantially envelopes both the base member and the bridge member. The bridge member includes a pin member projecting from a tip thereof for being inserted in a complementary opening in the combination dial to secure the dial against rotation. Tamper alarm circuitry is provided to generate a tamper alarm signal if an attempt is made to tamper with the combination dial or to damage the device. An alarm will also be generated if the lock remains in an unsecure state for more than a predetermined time interval, which is deemed adequate for an authorized user to conduct legitimate business in the compartment which is being protected by the combination dial lock. When both the protected compartment and the combination lock are properly secured, an electrical signal indicative thereof will be transmitted to the host controller and a visual display will inform the user that the lock has been properly secured. Means is provided for ensuring that the dial is rotated a prescribed number of times in a predetermined direction after the lock is returned to a "locked" state in order to properly "spin off" the combination.

16 Claims, 5 Drawing Sheets

(LOCKED)

(RELEASED)

(RE-LATCHING)

DIAL SENSOR

DEVICE FOR SECURING A COMBINATION DIAL LOCK

FIELD OF THE INVENTION

The present invention relates generally to combination dial locks and in particular to a device for securing a combination dial lock against unauthorized access and tampering.

BACKGROUND OF THE INVENTION

Combination dial locks are typically used to secure compartments such as safes, file drawers and the like against unauthorized access and tampering. Such locks are comprised of a locking mechanism which is actuated by the turning of a numbered dial. When the correct series of numbers corresponding to the lock combination is dialed in, the locking mechanism will be released to allow the protected compartment to be opened. Unauthorized access to the protected compartment is prevented by limiting persons who have knowledge of the lock combination to only those persons who have authorized access to the compartment.

DESCRIPTION OF THE PRIOR ART

According to prior practice, alarm systems of various types are used in connection with combination locks to prevent unauthorized access to high security compartments, such as compartments containing large amounts of money or sensitive military information. For example, tamper alarm circuitry may be used to generate an audible and/or visual alarm if one attempts to damage or break the combination lock.

One problem associated with such prior art security systems is that they do not adequately prevent "safe cracking" or the like wherein one can determine the lock combination by manipulating the dial without trying to forcibly enter the secure compartment. Furthermore, such prior art security systems do not take into account the length of time that an authorized person should be able to access the secure compartment in order to transact authorized business. Therefore, if an unauthorized person obtains access to the secure compartment by obtaining an authorized entry card or the like or by discovering the lock combination, he can enter the secure compartment for any length of time that he desires.

OBJECTS OF THE INVENTION

It is, therefore, the principal object of the present invention to provide an improved device for securing a combination dial lock.

Another object of the invention is to provide a device for determining the number of revolutions of the combination dial after the lock is returned to a "locked" state.

It is yet another object of the invention to provide a device for securing a combination dial lock in which an alarm is activated when the lock is in an unsecure state for more than a predetermined time interval.

Still another object of the invention is to provide a device for securing a combination dial lock in which an alarm is activated if an attempt is made to damage or tamper with the lock.

SUMMARY OF THE INVENTION

These and other objects are accomplished in accordance with the present invention wherein a device for securing a combination locking mechanism is comprised of securing means for engaging the locking mechanism to prevent the unauthorized operation thereof and means for disengaging the securing means from the locking mechanism to allow the locking mechanism to be operated upon the occurrence of a predetermined access condition.

In one aspect of the invention the locking mechanism has a rotatable dial which is secured against rotation by the securing means. In the preferred embodiment thereof the securing means includes a bridge member which is pivotally attached at one end thereof to a substantially fixed housing. Projecting from the opposite end of the bridge member is a pin member, which engages a complementary opening in the dial to secure the dial against rotation. The bridge member is preferably springbiased to move the pin member out of engagement with the dial. A latching member is provided in the housing for holding the bridge member in a substantially fixed position so that the pin member engages the dial. Upon the occurrence of a predetermined access condition, the latching member is automatically released to allow the bridge member to pivot out of engagement with the dial so that the dial can be rotated.

In another aspect of the invention means is provided for generating an alarm signal when the locking mechanism is in an unsecured state for more than a predetermined period of time. In one embodiment, the locking mechanism secures an access member to prevent access to a compartment which is closed off by the access member. The locking mechanism is in an unsecured state when the access member is open. In yet another embodiment the locking mechanism has a rotatable dial and the locking mechanism is in an unsecured state when it is unlocked and until the dial has been rotated a prescribed number of revolutions in a predetermined direction after the locking mechanism has been relocked. In the preferred embodiment the device further includes means for generating a tamper alarm signal in response to an unauthorized removal or attempted removal of the device from a fixed position relative to the locking mechanism.

In yet another aspect of the invention the status of a combination locking mechanism having a rotatable dial is monitored by identifier means disposed at a predetermined position on the dial, detector means disposed in a fixed position relative to the dial for detecting the identifier means and for generating a predetermined electrical signal each time the identifier means is moved past the fixed position during the rotation of the dial in a predetermined direction and means for counting the electrical signals to determine the number of revolutions of the dial in the predetermined direction. In one embodiment the identifier means is comprised of at least one detectable object and the detector means is comprised of first and second sensors for detecting the object and generating respective first and second signals indicative of the proximity of the object to the respective first and second sensors. The detectable object is positioned on the dial so that it will be detected by the first sensor before it is detected by the second sensor when the dial is rotated in the predetermined direction. In another embodiment counter means is provided which is enabled by the first electrical signal and is incremented by one by the second electrical signal if the first electrical signal precedes the second electrical signal and the second electrical signal is present after the cessation of the first electrical signal. The counter will be reset to "0" if the second electrical signal occurs before the first electrical signal or if the first electrical signal is present after the cessation of the second electrical signal, which indicates that the dial is not being rotated in the predetermined direction. In the preferred embodiment the first and second sensors are comprised of first and second magnetic switches for detecting a magnet positioned on the dial. Each time both of the magnetic switches are closed in the proper sequence, the counter means will be incremented by one until the counter reaches a pre-programmed count, at which time an opto-isolator circuit is energized, thereby closing a phototransistor switch, which indicates that the locking mechanism is in a secured state.

BRIEF DESCRIPTION OF THE DRAWINGS

Further objects and advantages of the invention will be apparent from the detailed description and claims when read in conjunction with the accompanying drawings wherein:

DETAILED DESCRIPTION OF THE PREFERRED EMBODIMENT

In the description which follows like parts are marked throughout the specification and drawings, respectively. The drawings are not necessarily to scale and in some instances proportions have been exaggerated in order to more clearly depict certain features of the invention.

Figure 2:
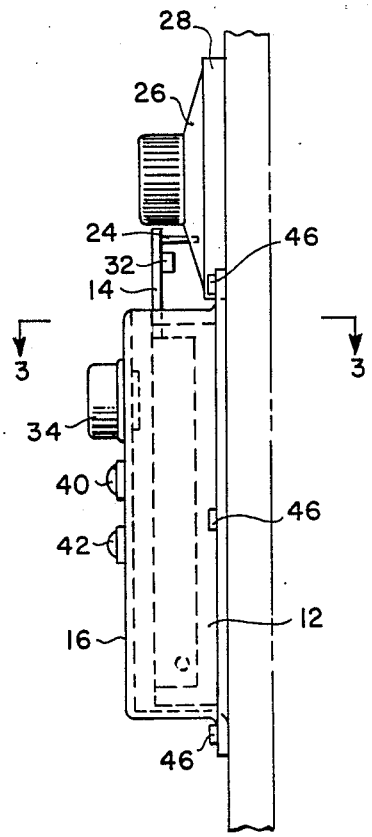
FIG. 2 is a side elevation view, illustrating the engagement of the device with a combination dial lock in accordance with the present invention.
Figure 3:
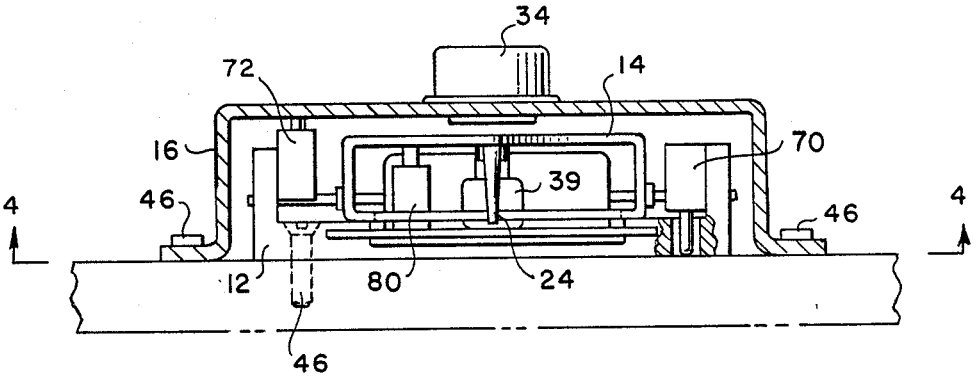
FIG. 3 is the front end view of the device according to the present invention.
Figure 4:
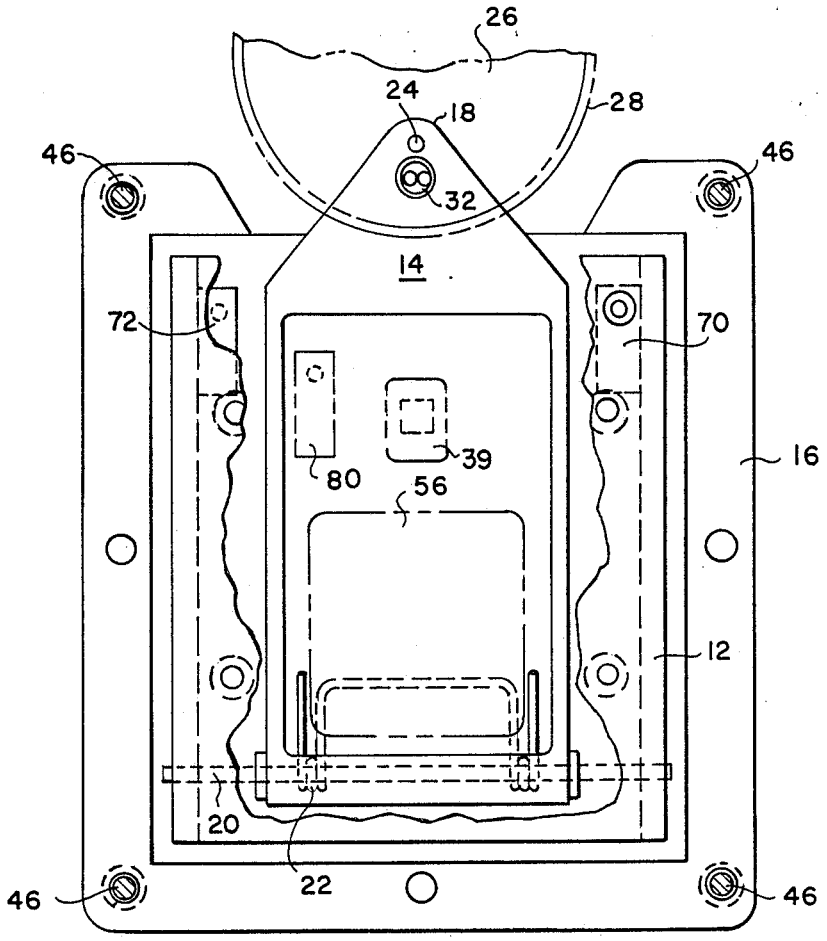
FIG. 4 is a bottom plan, partial cutaway view of the device in engagement with a combination dial lock in accordance with the present invention.

Referring to FIGS. 1–5, a device 10 for securing a combination dial lock according to the present invention is comprised of a substantially rectangular base member 12, a bridge member 14, which is pivotally attached at one end thereof to base member 12 and a cover member 16, which substantially envelopes base member 12 and bridge member 14. Bridge member 14 has a substantially rectangular shape and tapers down to a rounded tip 18 at a second end thereof opposite from a first end at which bridge member 14 is pivotally attached to base member 12. Bridge member 14 is attached to base member 12 by means of an elongated shaft 20, which extends between opposite sides of base member 12. As best shown in FIG. 4, a spring member 22 is also mounted on shaft 20 to spring-bias bridge member 14 in an upward direction toward cover member 16, as will be described in greater detail hereinafter.

Projecting downwardly from tip 18 of bridge member 14 is a pin member 24 for engaging a complementary opening in a dial 26 of a combination lock 28, as best seen in FIG. 2. Dial 26 is preferably of standard design with combination numbers printed on the face thereof. Rotation of dial 26 a predetermined number of times in each direction to call up the predetermined combination will allow lock 28 to be opened. Dial 26 also has one or more detectable objects 30 disposed on the face thereof for being detected by a corresponding pair of sensors 32 disposed on the underside of bridge member 14 to monitor the rotation of dial 26. Typically, dial 26 is turned clockwise to return lock 28 to a "locked" state after lock 28 has been opened. In order to properly secure lock 28 dial 26 should be turned clockwise several times (e.g., four complete revolutions) to "spin-off" the combination. The operation of sensors 32 will be discussed in greater detail hereinafter.

Figure 6A:
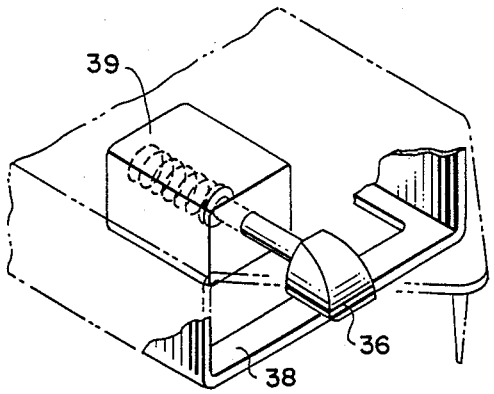
FIGS. 6A, 6B and 6C illustrate the latching member for holding the device in engagement with the dial.
Figure 6B:
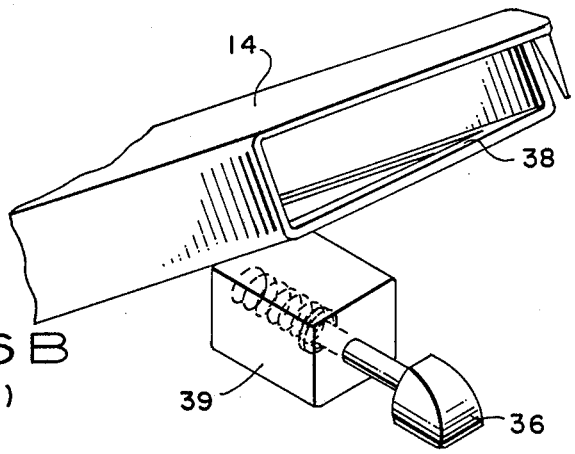
Figure 6C:
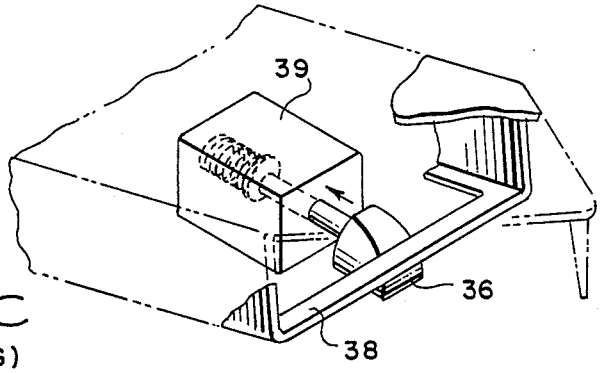

Disposed on cover member 16 is a push button 34, which allows the user to exert downward pressure on bridge member 14 to overcome the spring-bias tending to move bridge member 14 upwardly. Referring to FIGS. 6A, 6B and 6C, a latch 36 is disposed within base member 12 for engaging a lip 38 on bridge member 14 to hold down bridge member 14 against the spring-bias of spring member 22 so as to maintain pin member 24 within the complementary opening in dial 26. A release mechanism 39, which is preferably comprised of an electrically activatable solenoid, is used to disengage latch 36 from lip 38 to allow the spring-bias of spring member 22 to move bridge member 14 upwardly so that pin member 24 is disengaged from dial 26, thereby allowing the user to operate dial 26. The solenoid is spring-biased forward, as shown in FIG. 6A, when not activated and is retracted when electrically activated to move to the position shown in FIG. 6B. The spring bias on the solenoid will return latch 36 to the position shown in FIG. 6A so that lip 37 will contact the angled surface of latch 36 when bridge member 14 is pushed down again to re-latch the bridge, as shown in FIG. 6C. Lip 38 will push latch 36 back enough to overcome the forward spring bias and allow bridge member to return to a horizontal position in which pin member 24 engages dial 26 When lip 38 has cleared, the spring bias of the solenoid will move latch 36 forward to prevent bridge member from pivoting upwardly until latch 36 is released again.

The device 16 further include a pair of lightemitting diodes 40 and 42, which are used to indicate whether lock 28 is "secure" or "unsecure". Diode 40 indicates by means of a green light, that lock 28 is in a secured state, while diode 42 indicates by means of a red light that lock 28 is in an unsecured state, as described in greater detail hereinafter.

Figure 1:
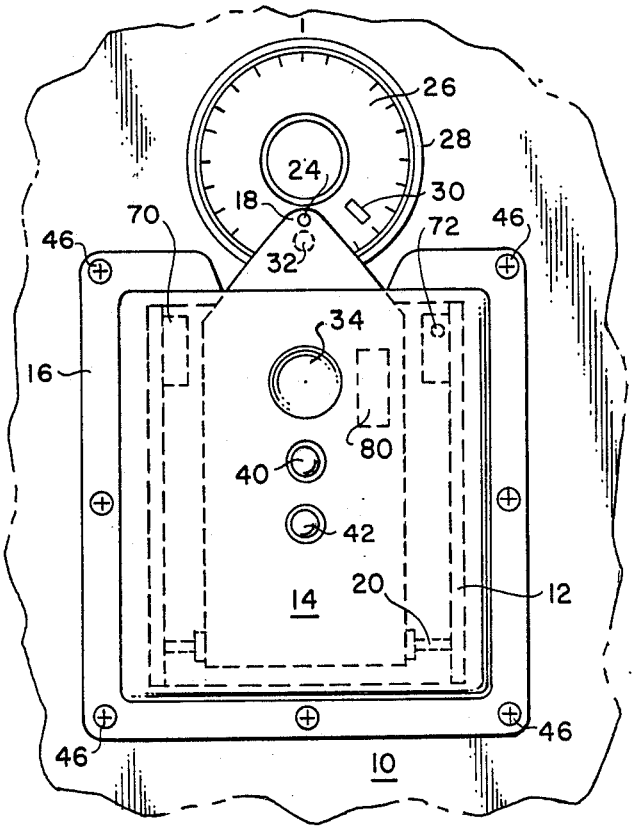
FIG. 1 is a top plan view of a device for securing a combination dial lock in accordance with the present invention.

In operation device 10 is mounted in a substantially fixed position on the surface of an access member 44, such as a door, file cabinet or the like, through which access to a secure compartment behind access member 44 is obtained. Device 10 is secured to the surface of access member 44 by means of mounting bolts or screws 46, which mount base member 12 and cover member 16 in a substantially fixed position. Bridge member 14 is pivotally moveable to a limited degree within the confines of base member 12 and cover member 16. As best seen in FIGS. 1, 2 and 4, the tapered portion of bridge member 14, which includes tip 18, extends outwardly from the enclosure formed by base member 12 and cover member 16. When lock 28 is in a secured state, with pin member 24 in engagement with dial 26 to prevent the rotation thereof, bridge member 14 will be held down by latch 36 until latch 36 is released by release mechanism 39.

Figure 7:
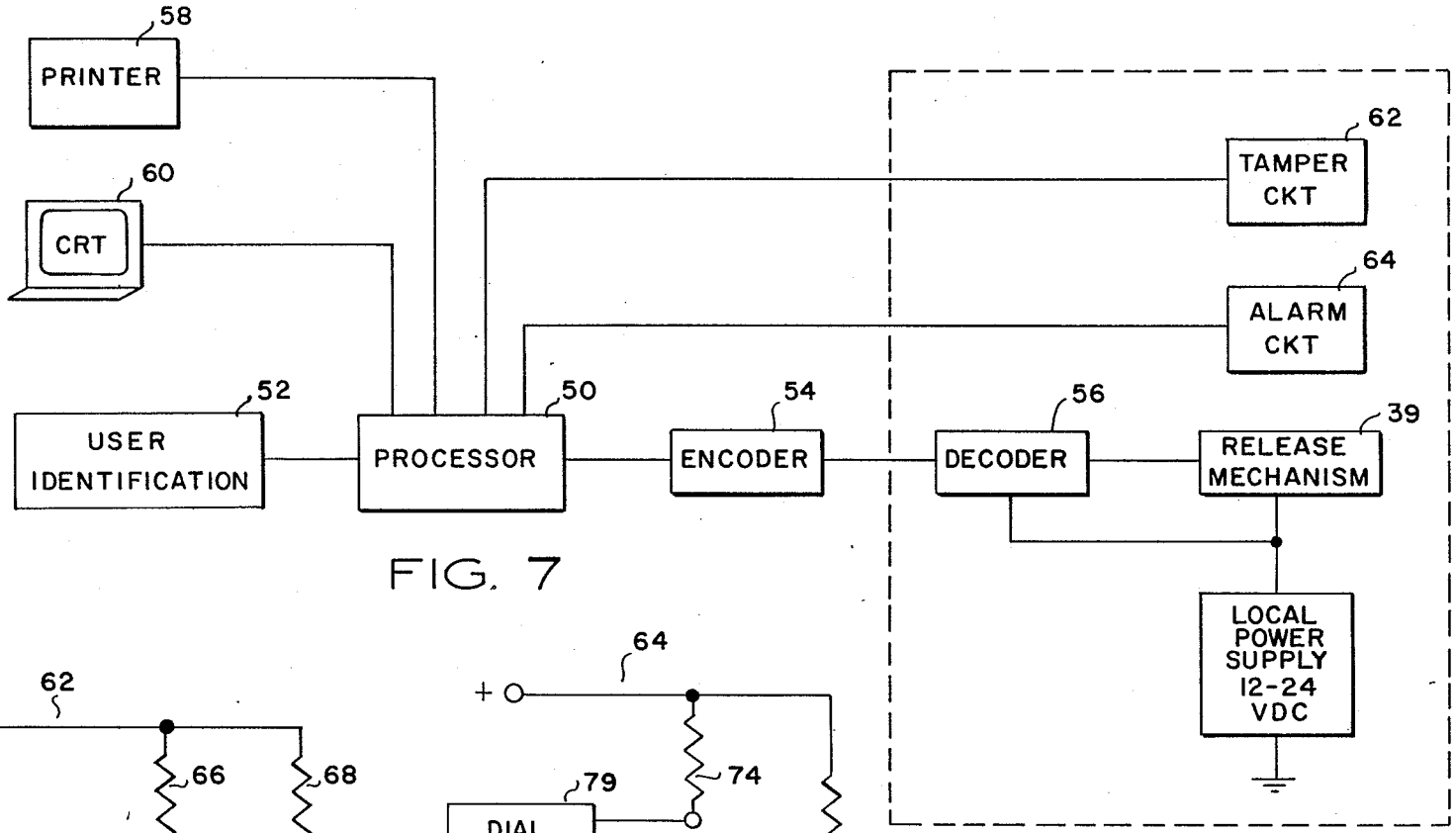
FIG. 7 is a block diagram of the device and control system circuitry in accordance with the present invention.

Referring now to FIG. 7, device 10 ha associated therewith a processor 50, which functions as a host controller for device 10. Processor 50 is pre-programmed to control access to the secure compartment which is protected by lock 28 and access member 44, such that a potential user must first be identified by processor 50 before gaining access to the secure compartment. Processor 50 is preferably of the type used as a host controller for security systems, such as the access controller, manufactured and sold by Proprietary Control Systems Corporation of Carson, California. An individual desiring access to the secure compartment typically enters an identification or clearance code via an encoded card presented to a used identification device 52, such as a card reader, input key pad, or biometric identifier. If an authorized person is indicated, processor 50 will activate a relay circuit, which is connected to an encoder 54. Encoder 54 in turn transmits a "release" signal to a decoder 56, which is preferably located on a printed circuit board within base member 12, as best seen in FIG. 4. Decoder 56 will decode the signal transmitted from encoder 54 and will send an electrical signal via a relay circuit to activate release mechanism 39. The activation of release mechanism 39 will retract latch 36 and allow tip 18 of bridge member 14 to spring upwardly and out of engagement with dial 26, to allow dial 26 to be operated.

Encoder 54 and decoder 56 are preferably of the type manufactured and sold under model number DRS 100 by Cybertel, Inc., of Garden Grove, California. Peripheral equipment such as printer 58 and CRT 60 may be connected to processor 50 to provide a visual and/or hard copy record of the event, which may include the identify of the user who was granted access to the secure compartment, the user's identification code, the time of day and date of access, etc. Processor 50 maintains a chronological record of accesses granted and accesses denied, which is available for display via printer 58 and/or CRT 60. The activation of releases mechanism 39 by decoder 56 results in the supply of DC voltage in the range of 12 to 24 volts directly to release mechanism 39, which will move latch 36 out of engagement with lip 38 to release bridge member 14, as previously described.

Figure 9:
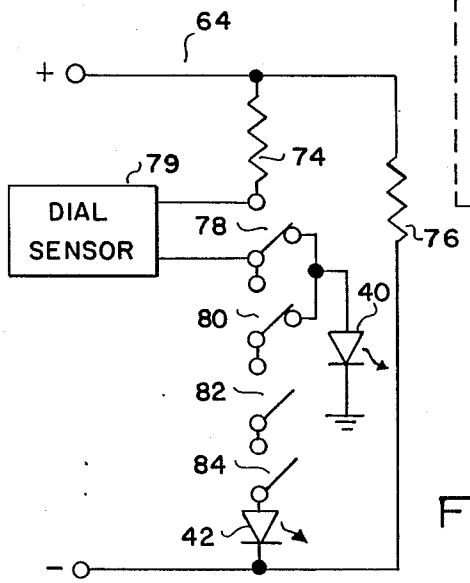
FIG. 9 is a circuit diagram of the alarm circuitry used in connection with the device.
Figure 8:
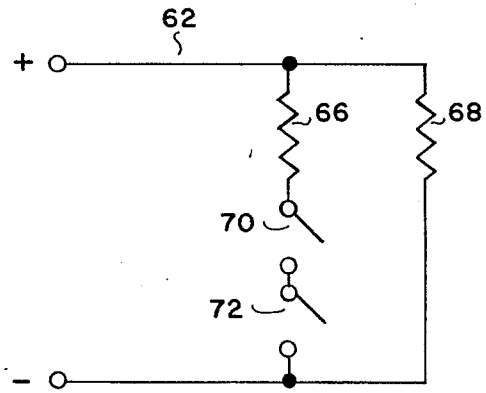
FIG. 8 is a circuit diagram of the tamper circuitry used in connection with the device.

Referring also to FIGS. 8 and 9, device 10 includes a tamper circuit 62 and an alarm circuit 64. FIG. 8 illustrates tamper circuit 62, which is comprised of a pair of parallel resistors 66 and 68 and a pair of switches 70 and 72 in series with resistor 66. The electrical resistance of resistor 66 is preferably substantially less than that of resistor 68 so that when both switches 70 and 72 are closed, current will be shunted through resistor 66. By applying a predetermined voltage across resistors 66 and 68, processor 50 can determine the path being taken by the electrical current by measuring the amplitude of the current. For example, in the case where the Model SCS 90 host controller or a similar host controller is used as processor 50, the values of resistors 66 and 68 are preferably on the order of 200 OHMS and 10K OHMS, respectively, so that the amplitude of the electrical current flowing through the circuit will be approximately fifty times greater when switches 70 and 72 are closed. Switches 70 and 72 are preferably comprised of respective first and second microswitches for detecting any attempts to tamper with device 10 by removing it from its fixed position relative to combination lock 28. Switch 70 is preferably used to detect an attempt to remove base member 12 from the surface of access member 44. Switch 70 is normally in a closed position, as best seen in FIG. 3. If base member 12 is removed from the surface of access member 44, switch 70 will open, which will cause current to flow through resistor 68 instead of resistor 66 and activate a tamper alarm. Similarly, switch 72 is normally closed when cover member 16 is properly positioned over bridge member 14 and base member 12. If an attempt is made to remove cover member 16 to get access to bridge member 14 and the other components within base member 12, switch 72 will open, which will also cause current to flow through resistor 68 instead of resistor 66, thereby activating the tamper alarm.

Figure 5:
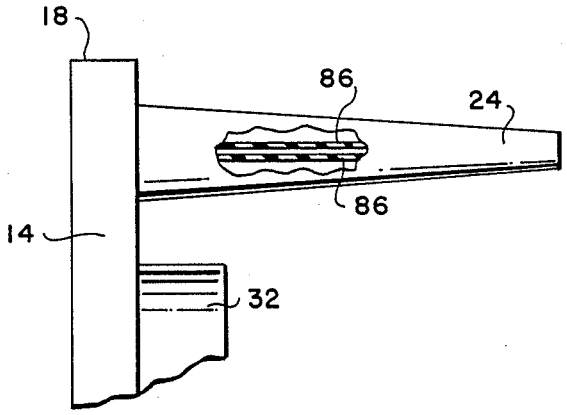
FIG. 5 is a detailed view of a front portion of the device, illustrating the pin member which secures the combination dial against rotation.

FIG. 9 depicts alarm circuit 64, which functions to indicate whether combination lock 28 is in a secured or unsecured state. Alarm circuit 64 also includes a pair of resistors 74 and 76 coupled in parallel between a predetermined voltage. Resistor 76 has a substantially greater electrical resistance value than resistor 74, with substantially the same resistive ratio as between resistors 64 and 66 described above. Four switches 78, 80, 82 and 84 are coupled in series with resistor 74 to provide a relatively low resistance current path when switches 78, 80, 82 and 84 are all closed. When lock 28 is properly secured, all four switches are in their respective closed positions. Switch 78 is in a closed position when dial 26 has been rotated the prescribed number of times in the same direction (e.g., four complete revolutions clockwise) after lock 28 has been returned to its locked state (i.e., after dial 26 has been moved off the last number of the lock combination), as determined by dial sensor circuitry 79. Switch 78 will remain open until dial 36 has been rotated the prescribed number of times to "spin off" the combination. Switch 80 monitors the position of bridge member 14, such that switch 80 will be closed, as best seen in FIG. 3, when bridge member 14 is being held down by latch 36 so that pin member 24 engages dial 26 to prevent the rotation thereof. Switch 82 monitors the status of access member 44 and is preferably comprised of a magnetic proximity switch, which is in a closed position when access member 44 is shut. Switch 84 monitors the status of pin member 24 and preferably includes an pair of electrical conductors 86, which are passed through at least a portion of pin member 24, as shown in FIG. 5. If an attempt is made to break or damage pin member 24, electrical conductors 86 will be broken, which will open switch 84 and generate an alarm signal.

One skilled in the art will appreciate that in order for an authorized user to gain access to the secure compartment, switches 78, 80 and 82 will be in an open position during the time that access member 44 is open and lock 38 is unsecured. Therefore, processor 50 is programmed not to generate an alarm signal for a predetermined time interval beginning at the time that the first of these three switches is properly opened. The first switch to be opened is typically switch 80, which occurs when latch 36 is released to allow bridge member 14 to pivot upwardly. Thus, an authorized user is allocated an amount of time equal to the pre-programmed time interval in order to dial in the combination, open access member 44 and take care of the necessary business within the secure compartment and re-secure the compartment by closing access member 44, spinning off the combination by turning dial 26 the prescribed number of times in the predetermined direction and re-latching bridge member 14 so that pin member 24 engages dial 26 to prevent the rotation thereof. If all of these events have not taken place within prescribed time interval, an alarm signal will be sounded.

Figure 10:
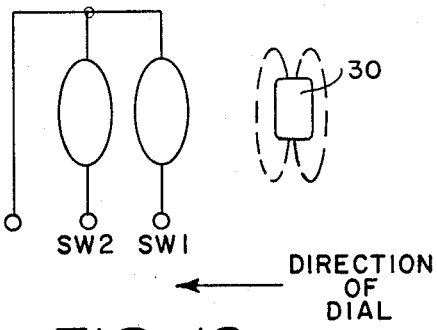
FIG. 10 illustrates the sequential detection of a magnet mounted on the dial by two magnetic switches.

Referring to FIG. 10, sensors 32 are preferably comprised of a pair of magnetic switches 1 and 2 for detecting the passage of a magnet 30 as dial 26 is rotated in a clockwise direction. Switches 1 and 2 are positioned so that switch 1 detects magnet 30 before switch 2 when dial 26 is rotated in the proper direction for spinning off the lock combination (i.e., clockwise, as one faces dial 26). Switch 1 is closed first, followed by switch 2 as magnet 30 approaches. As magnet 30 moves away, switch 1 will open first, followed by switch 2.

Figure 11:
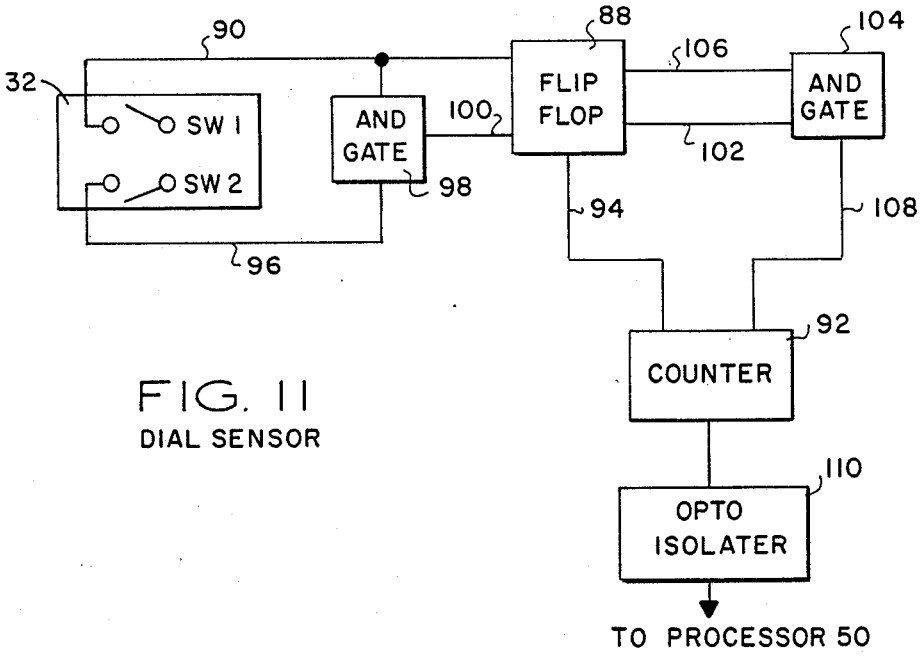
FIG. 11 is a block diagram, illustrating the operation of the sensors used for monitoring the rotation of the combination dial.

Referring to FIG. 11, when switch 1 is closed by the passage of magnet 30 in proximity thereto, an enable signal is sent to a flip flop circuit 88 on line 90 and to a counter 92 on line 94. When switch 2 detects magnet 30, it will close, thereby sending an electrical signal on line 96 to AND gate circuit 98. The signals on lines 90 and 96 will cause AND gate circuit 98 to send a signal to flip flop circuit 88 on line 100, which toggles flip flop circuit 88. When flip flop circuit 88 changes state, its output is transmitted on line 102 to a second AND gate circuit 104. Second AND gate circuit 104 also receives an enable signal from switch 1 via flip flop circuit 88, so that when flip flop circuit 88 changes state, second AND gate circuit transmits a signal on line 108 to increment counter 92. As dial 26 continues its rotation, magnet 30 will move away from respective switches 1 and 2, thereby causing first switch 1 and then switch 2 to go open again.

Therefore, with each rotation of dial 26 in a clockwise direction, switches 1 and 2 will be sequentially closed as magnet 30 moves into proximity therewith. The sequential closure of both switches 1 and 2 will increment counter 92 with each rotation of dial 26 so that the number of times that dial 26 is rotated in the clockwise direction can be determined. Counter 92 can be set for any prescribed number of rotations. When the prescribed number of rotations has been achieved, an opto-isolator circuit 110 will be activated to generate light energy by means of a light emitting diode and turn on a phototransistor or the like comprising switch 78, described above with reference to FIG. 9.

Figure 12:
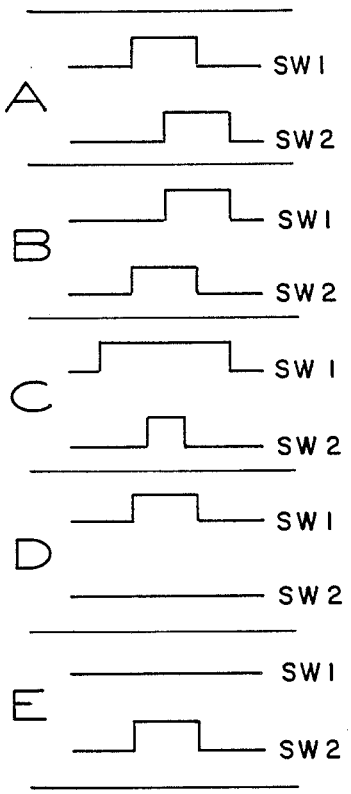
FIG. 12 illustrates the various electrical signals generated by the closing and opening of the two magnetic switches in various sequences.

Referring to FIG. 12, various signals are depicted indicating the closed and open positions of switches 1 and 2. Signals A illustrates the proper signal sequence in which switch 1 is closed first and then switch 2 is closed (i.e., the dial is rotated clockwise). Switch 2 remains closed for a time after switch 1 opens. This sequence causes counter 92 to increment by one. Signals B illustrate the sequence of closure of switches 1 and 2 in which dial 26 is rotated in the "wrong" direction (i.e., in the counterclockwise direction). When this occurs, counter 92 will be reset to "0" because a reset pulse will be transmitted to counter 92 on line 108 by the closure of switch 2 before counter 92 is enabled on line 94 by the closure of switch 1. Signals C illustrate a change of direction of dial 26 while magnet 30 is in proximity to switch 1. These signals will also cause the counter to reset to "0" because switch 1 remains closed after switch 2 goes open, indicating rotation of dial 26 in the wrong direction. Signals D and E illustrate the respective situations in which only one of the switches (switch 1 in signals D and switch 2 in signals E) is closed. Either of these two sequences will not affect counter 92.

Figure 13:
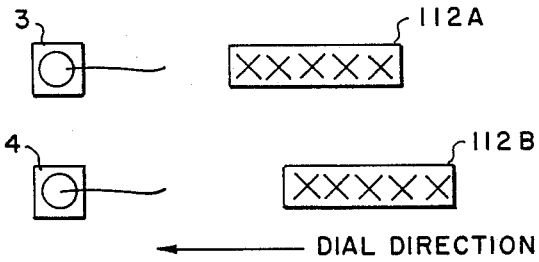
FIG. 13 illustrates the sequential detection of two marks mounted on the dial by two optical detectors.

In this manner, the system is able to determine not only the number of rotations of dial 26, but also that the prescribed number of rotations of dial 26 in the proper direction has occurred in order to properly spin off the combination and secure the locking mechanism. In an alternate embodiment, as shown in FIG. 13, a pair of opto-electronic sensors 3 and 4 may be used in lieu of magnetic switches 1 and 2 to detect a bar code or the like positioned on dial 26. When optical sensors are used, a pair of staggered marks 112A and 112B are preferably disposed on dial 26 so that each opto-electronic sensor detects on of the marks. Because of the staggered marks, the first sensor will detect its associated mark before the second sensor detects its associated mark. Otherwise, the number of rotations of dial 26 in the predetermined direction is determined in substantially the manner described above with reference to the magnetic sensors.

Various embodiments of the invention have now been described in detail. Since it is obvious that many changes in and additions to the above-described preferred embodiment may be made without departing from the nature, spirit and scope of the invention, the invention is not to be limited to said details except as set forth in the appended claims.

What is claimed is:

1. A device for securing a combination locking mechanism, comprising:

a base member for being mounted in a fixed position relative to said locking mechanism;

a cover member for substantially enveloping said base member to prevent access to said base member;

securing means for engaging the locking mechanism when the base member is mounted in said fixed position, to prevent the unauthorized operation of said locking mechanism;

means for disengaging said securing means from said locking mechanism to allow said locking mechanism to be operated upon the occurrence of a predetermined access condition;

means for generating an alarm signal when said locking mechanism is in an unsecured state for more than a predetermined period of time; and means for generating a tamper alarm signal in response to an unauthorized removal or attempted removal of said device from said fixed position, said tamper alarm signal being generated in response to an unauthorized removal or attempted removal of said cover member from said base member or said base member from said fixed position.

2. The device according to claim 1 wherein said locking mechanism is positioned for securing an access member to prevent access to a compartment which is closed off by said access member, said locking mechanism being in an unsecured state when said access member is open.

3. A device for securing a combination locking mechanism, said locking mechanism having a rotatable dial, said device comprising:

securing means for engaging the locking mechanism to prevent the unauthorized operation thereof;

means for disengaging said securing means from said locking mechanism to allow said locking mechanism to be operated upon the occurrence of a predetermined access condition; and means for generating an alarm signal when said locking mechanism is in an unsecured state for more than a predetermined period of time, said locking mechanism being in an unsecured state when it is in an unlocked state and until the dial has been rotated a prescribed number of revolutions in a predetermined direction after the locking mechanism has been returned to a locked state.

4. The device according to claim 3 further including means for determining the number of revolutions of said dial and for providing an indication thereof when the prescribed number of revolutions in said predetermined direction has been accomplished.

5. The device according to claim 3 wherein said locking mechanism is in an unsecured state when said securing means is disengaged from said locking mechanism.

6. A device for securing a combination locking mechanism having a combination dial with an opening therein, said device comprising:

securing means for engaging the locking mechanism to prevent the unauthorized operation thereof, said securing means having a pin member projecting therefrom for being received within said opening to secure said dial against rotation;

means for disengaging said securing means from said locking mechanism to allow said locking mechanism to be operated upon the occurrence of a predetermined access condition; and means for generating an alarm signal when said locking mechanism is in an unsecured state for more than a predetermined period of time.

7. The device according to claim 6 further including latching means for holding said securing means in engagement with said locking mechanism to maintain said pin member within said opening.

8. The device according to claim 7 wherein said disengaging means is comprised of an electrically activatable release member for disengaging said latching means in response to an electrical signal indicating that said access condition has been met to remove said pin member from said opening and allow the dial to be rotated.

9. The device according to claim 6 further including means for generating an alarm signal in response to breakage or substantial damage to said pin member.

10. A device for securing a combination locking mechanism, comprising:

securing means for engaging the locking mechanism to prevent the unauthorized operation thereof;

means for disengaging said securing means from said locking mechanism to allow said locking mechanism to be operated upon the occurrence of a predetermined access condition;

means for controlling access to said locking mechanism until said access condition occurs, said access condition being met when said control means identifies an individual who is authorized access to said locking mechanism; and means for generating an alarm signal when said locking mechanism is in an unsecured state for more than a predetermined period to time.

11. The device according to claim 10 further including means for maintaining a chronological record of said access condition being met or not being met on all attempts to access said locking mechanism.

12. The device according to claim 11 further including means for providing a visual display of said chronological record.

13. A method of securing a combination locking mechanism, said locking mechanism having a rotatable dial, said method comprising the steps of:

providing a device for securing the locking mechanism;

positioning said device relative to said locking mechanism so that said device engages the locking mechanism to prevent the unauthorized operation thereof;

providing means for disengaging said device from said locking mechanism and selectively controlling said disengaging means to allow said locking mechanism to be operated in response to a predetermined access condition; and generating an alarm signal when said locking mechanism is in an unsecured state for more than a predetermined period of time, said locking mechanism being in an unsecured state when said device is disengaged from said locking mechanism, when said locking mechanism is in an unlocked state and until the dial has been rotated a prescribed number of revolutions in a predetermined direction after the locking mechanism has been returned to a locked state.

14. The method according to claim 13 further including the step of monitoring the position of said device relative to said locking mechanism and generating a tamper alarm signal in the event that an unauthorized removal or attempted removal of said device or any part thereof from its position relative to the locking mechanism.

15. A device for securing a combination locking mechanism having a rotatable dial, said device comprising:

securing means for engaging the locking mechanism to secure the dial against rotation;

means for positioning said securing means relative to said locking mechanism to allow said securing means to engage the locking mechanism; and means coupled to said positioning means for disengaging said securing means from said locking mechanism to allow said dial to be rotated upon the occurrence of a predetermined access condition, said positioning means being comprised of a housing for being mounted in a fixed position relative to said locking mechanism and said securing means being comprised of a bridge member which is pivotally attached at one end thereof to said housing, said bridge member having a pin member projecting from an opposite end thereof from said one end at which said bridge member is pivotally attached to said housing, said pin member for being received within a complementary opening in said dial to secure said dial against rotation.

16. The device according to claim 15 wherein said bridge member is spring-biased so that said opposite end thereof from which said pin member projects tends to pivot away from said dial, said device further including latch means positioned within said housing for holding said bridge member in a substantially fixed position so that said pin member is received within said complementary opening in said dial and release means for automatically disengaging said latch means to allow said bridge member to pivot away from said dial when said predetermined access condition is met.

* * * * *